United States Patent [19]

Godijn

[11] Patent Number: 4,662,351

[45] Date of Patent: May 5, 1987

[54] STOVE FOR COMBUSTING BOTH LIQUID AND SOLID FUELS

[75] Inventor: Willem Godijn, Hilversum, Netherlands

[73] Assignee: Research Instituut Sesto B.V., Hilversum, Netherlands

[21] Appl. No.: 705,943

[22] Filed: Feb. 26, 1985

[30] Foreign Application Priority Data

Mar. 6, 1984 [NL] Netherlands ..... 8400721

[51] Int. Cl.[4] ..... F24H 3/00

[52] U.S. Cl. ..... 126/111; 126/76; 126/67; 126/58; 110/260

[58] Field of Search ..... 110/260, 233; 126/36, 126/60, 65, 67, 58, 76, 77, 75, 86, 94, 93, 4, 1 D, 84, 17, 273.5, 224, 225, 222, 223, 137, 122, 123, 126, 136, 103, 111

[56] References Cited

U.S. PATENT DOCUMENTS

| | | | |
|---|---|---|---|
| 286,248 | 10/1883 | Allen | 126/1 D |
| 580,078 | 4/1897 | Asbury | 126/224 |
| 603,742 | 5/1898 | Ryley | 126/75 |
| 840,488 | 1/1907 | Hamaker | 126/4 |
| 1,236,280 | 4/1917 | Ferry | 126/86 |
| 1,717,657 | 6/1929 | Box | 126/76 |
| 2,043,316 | 6/1936 | Bennett | 126/36 |
| 2,288,028 | 6/1942 | Richardson | 126/75 X |
| 4,141,335 | 2/1979 | Wright | 126/111 |
| 4,222,364 | 9/1980 | Wright | 126/111 |

FOREIGN PATENT DOCUMENTS

| | | | |
|---|---|---|---|
| 472573 | 4/1947 | Belgium . | |
| 1056808 | 1/1957 | Fed. Rep. of Germany | 110/260 |
| 861873 | 2/1941 | France | 126/60 |
| 2314443 | 1/1977 | France . | |
| 352120 | 3/1961 | Switzerland . | |
| 383586 | 1/1965 | Switzerland . | |

*Primary Examiner*—Randall L. Green

*Attorney, Agent, or Firm*—Sughrue, Mion, Zinn, Macpeak & Seas

[57] ABSTRACT

A stove for combusting both liquid and solid fuels, said stove comprising: a burner area in which the burner for liquid fuel is located, a collecting area for combustion gas above said burner area and connected therewith; a discharge conduit for the combustion gas connected to the horizontal upper wall of that collecting area; and a combustion area for solid fuel provided in said collecting area and extending itself over the full length of this area and consisting of a lower V-shaped plate, two vertically extending side plates and a horizontally extending upper plate, all these plates being positioned at some distance of the corresponding walls of said collecting area, openings being provided in the upper part of the side walls of said combustion area for allowing the combustion gas of the solid fuel to evade towards the discharge conduit.

6 Claims, 3 Drawing Figures

STOVE FOR COMBUSTING BOTH LIQUID AND SOLID FUELS

FIELD OF INVENTION

The invention relates to a stove for combusting both liquid and solid fuels, which stove comprises a burner area in which a burner for liquid fuel is located, with above this burner area and connected thereto a collecting area of recombustion gas of which collecting area the horizontal upper wall is connected to a discharge conduit of the combustion gas, while in the collecting area a separating plate may be positioned for combusting solid fuel above said plate, said separating plate extending over the full length of the collecting area.

A burner for liquid fuel, which may be applied in the stove described above is for example known from German Patent Specification No. 2,513,364.

BACKGROUND OF THE INVENTION

If at a certain moment a shortage of liquid fuel would develop, for example because the user is in an area difficultly accessible because of weather conditions, it is advantageous if the stove could also be used for combusting solid fuels, such as for example wood or coal.

To that purpose, in the known stove a separating plate is lowered from above into the collecting area, which separating plate covers the burner area. Above the separating plate solid fuel then is burned.

If it is desired to change over to burning liquid fuel again, the separating plate has to be removed which, of course, is only possible when the stove has cooled down completely. On removal there is, however, the risk that ash will enter into the burner area and the burner is made filthy, which risk also occurs when the separating plate does not completely close off the underlying burner area.

SUMMARY OF INVENTION

It is, accordingly, an object of the invention, to improve such a stove such, that it is immediately suitable for the combustion of solid fuel, without any alterations of the stove being required when switching from liquid to solid fuel or vice versa.

According to the invention this is achieved in that the separating plate is positIOned at some distance above the burner area and is fitted to the front-wall and rear-wall of the collecting area and, at least partially, does not extend over the full width of the collecting area, substantially vertically upwards extending plates being fitted to the longitudinal rims of the separating plate, the upper rims of said plates being connected to each other by a substantially horizontally extending upper plate, positioned at some distance below the upper wall of the collecting area such that a closed combustion area for solid fuel is formed, which fuel may be introduced into the combustion area by means of a door, provided in the front wall, while the walls in the upper part of the combustion area are provided with openings for allowing the combusitn gas to evade towards the discharge conduit for combustion gas.

Thus an essentially closed combustion area for solid fuel is obtained within the collecting area for combustion gas. The presence of this combustion area appears to have no effect on the combustion of the liquid fuel, a sufficient free cross-section between the side-walls being of course required for the combustion gas of the liquid fuel, so that the discharge of this combustion gas is not or only slightly hampered by the presence of the combustion area.

It will be obvious that the side-walls of the combustion area may be exposed to high temperatures during the combustion of solid fuel in the combustion area. In order to prevent deformation of the side-walls it is provided that the side-walls of the combustion area are supported externally by longitudinal rims of the legs of substantially U-shaped channels connected to the side walls, said channels extending in a vertical direction between the lower wall and the upper wall of the collecting area and at the same time may form the side walls of the collecting area.

The U-shaped channels thus act as stiffening ribs and simultaneously provide for the heat transfer from the side walls of the combustion area to the environmental air to be heated. The side walls of the combustion area will thus assume a less high temperature also during use of the combustion area for solid fuel.

According to a preferred embodiment of the invention the openings for allowing combustion gas to leave the combustion area will be provided in the side walls of the combustion area and emerge into the U-shaped channels.

A simple construction can be achieved when the U-shaped channels of a side wall together form one unit and are obtained by bending a flat plate a number of times, the legs of the U-shaped channels forming an obtuse angle with the outer parts of the U-shaped channels, which are positioned in one plane.

Viewed from the outside of the collecting area the legs of adjacent U-shaped channels thus do not run parallel to each other, but they are directed towards each other, whereby a better heat emission towards the environment is obtained.

For a proper transport of the combustion gas from the burner area while combusting liquid fuel according to a preferred embodiment of the invention, the provision can be made that the separating plate, viewed in cross-section, is V-shaped. By this the combustion gas rising from the burner area is distributed by the separating wall and is transported towards the two side-walls of the collecting area.

According to a further embodiment the provision can be made that a grate is positioned above the separating plate in such a manner that an ash pan can be positioned in the area between the separating plate and the grate.

In addition an adjustable air-slide may be applied in the door at about the level of the ash pan, for adjusting the combustion in the combustion area and means which can be activated will be present to prevent air from flowing to the collecting area via the burner area while using the combustion area for solid fuel.

The air slide, of course, should be executed such that it can be closed completely when the stove is used for combusting liquid fuel, as otherwise a false draught might be drawn via the air-slide and the openings in the side walls of the combustion area. For the same reason the door of the combustion area should seal off properly with respect to the front wall of the collecting area.

In addition it is required that no air can flow via the burner area towards the collecting area when the combustion area is in use, as otherwise air will flow via the burner area towards the discharge conduit for the combustion gas and an insufficient draught will occur in the combustion area.

According to a preferred embodiment of the invention the means, which can be activated for preventing air from flowing to the collecting area via the burner area is formed by a plate, which may be shoved over the opening of the burner area to close it off, said plate being positioned via a substantially horizontal slot, made in the front or rear wall of the collecting area at the joining of the burner area and the collecting area.

If the stove is used for the combustion of solid fuel in the combustion area, air can only flow into the burner area via the air-slide in the door below the grate, after positioning of the plate, thus providing an optimal draught.

It will be obvious that in the absence of the plate, thus when combusting liquid fuel, the slot to be made in the front or rear wall will be preferably closed, e.g. by inserting in it a plate with a very short length.

BRIEF DESCRIPTION OF THE DRAWING

For a better understanding of the invention, as well as the above and other objects and the nature and advantages of the instant invention, a possible embodiment thereof will now be described with reference to the attached drawings, it being understood that this embodiment is to be intended as merely exemplary and in no way limitative.

DETAILED DECRIPTION OF PREFERRED EMBODIMENT

Figure 1:
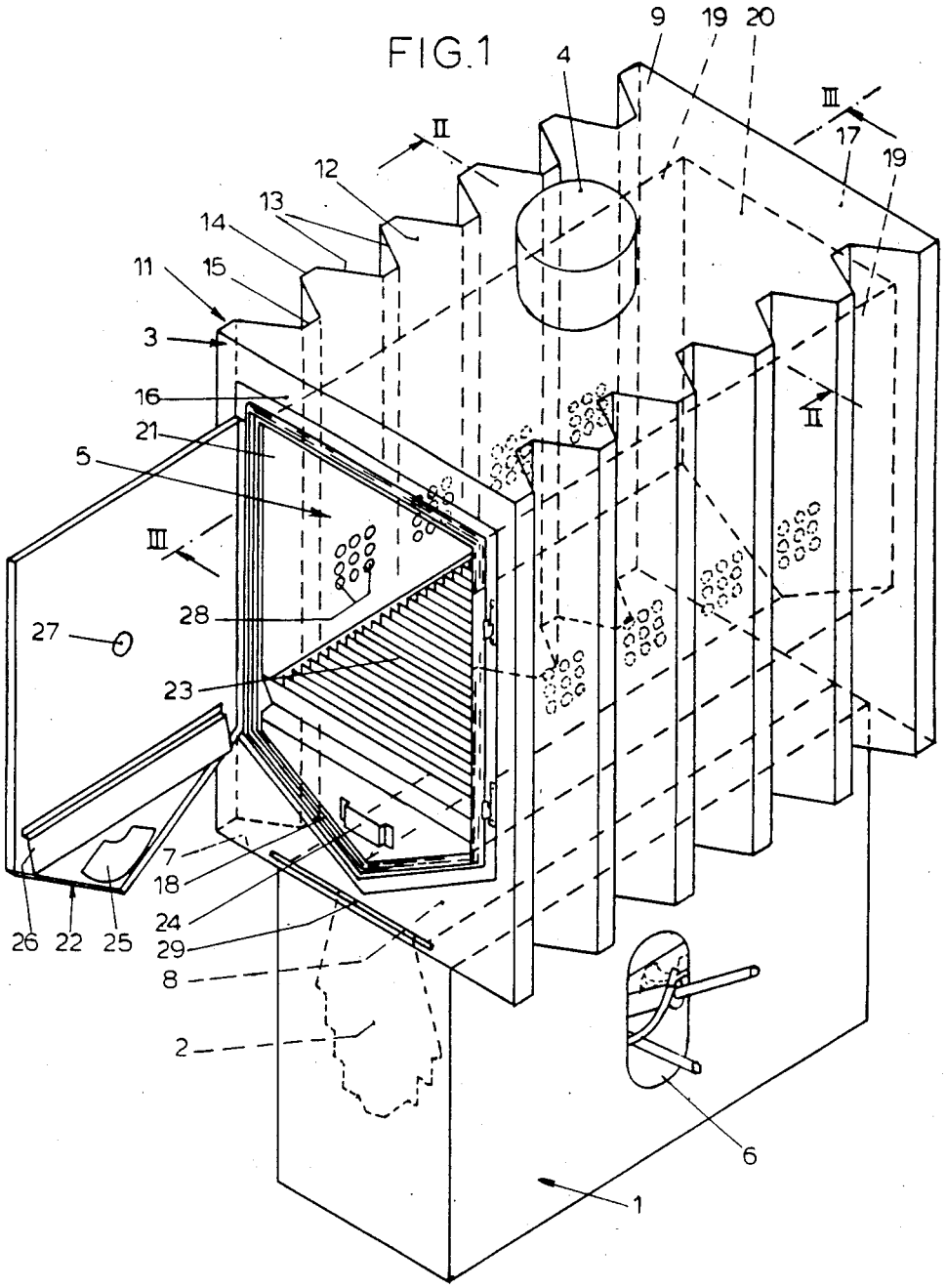
FIG. 1 schematically shows a perspective view of a stove according to the present invention.

The stove shown in the drawing comprises a liquid fuel burner area housing or compartment 1, in which a burner 2 for liquid fuel is present. Above the burner area housing 1 the collecting area housing a combustion gas collecting chamber 3 for combustion gas is located, to which collecting area housing the discharge conduit 4 is connected, while the solid fuel combustion area or chamber 5 for solid fuel is located within the collecting area housing 3.

The burner 2 may e.g. correspond with the burner as described in the above mentioned German Patent No. 2,513,364. In the housing 1 mounted around this burner is an opening 6 through which extend a control means and a supply line for the liquid fuel, not shown in detail.

In the bottom plate 7 of the collecting area 3 a slot 8 is present, through which the combustion gas formed in the burner 2 may flow to the housing 3. The housing 3 is closed off at the upper end by the upper wall 9 with in it an opening 10 connecting to the discharge conduit 4.

The side walls 11 of the collecting area housing are formed by a plate, which has been bent a number of times such that U-shaped channels 12 are created, composed of the legs 13 and the connecting parts 14 and 15. At the front side, collecting area housing 3 is closed off by a front wall 16 and at the rear side by the rear wall 17.

The combustion area or chamber 5 is defined by V-shaped separating plate 18, side plates 19 and upper plate 20, which is located at some distance below the upper wall 9 of the collecting area 3.

The plates 18, 19 and 20 extend themselves over the full length between the front wall 16 and the rear wall 17 of the collecting area housing 3. In the front wall 16 of the collecting area 3 an opening 21 has been made, which provides access to the combustion area 5, and may be closed off by means of a door 22.

Figure 3:
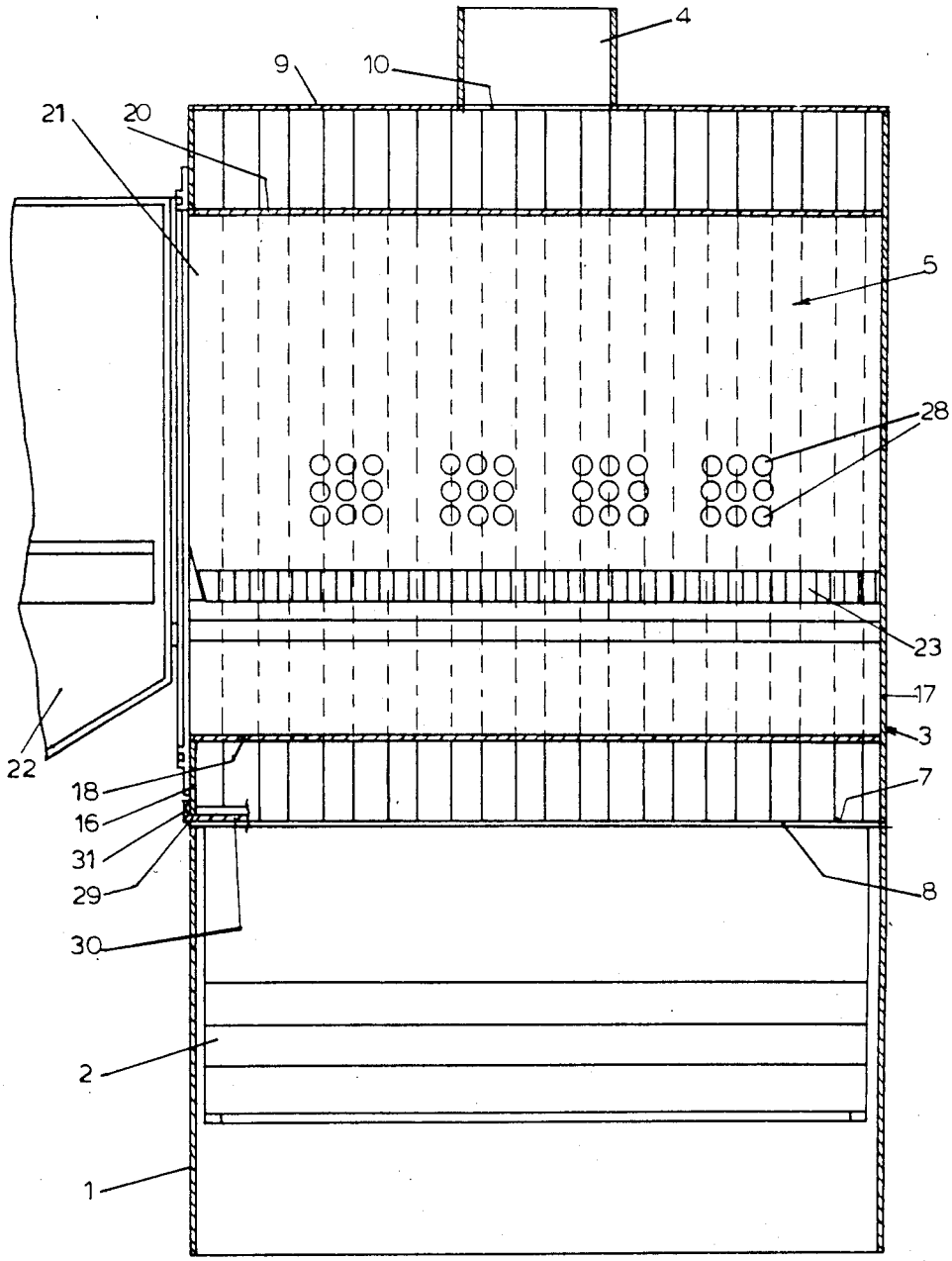
FIG. 3 schematically shows a longitudinal section taken along line III—III of FIG. 1.

In FIG. 1 and 3 door 22 is shown in the opened position but when the device is in use, the door will be closed.

Figure 2:
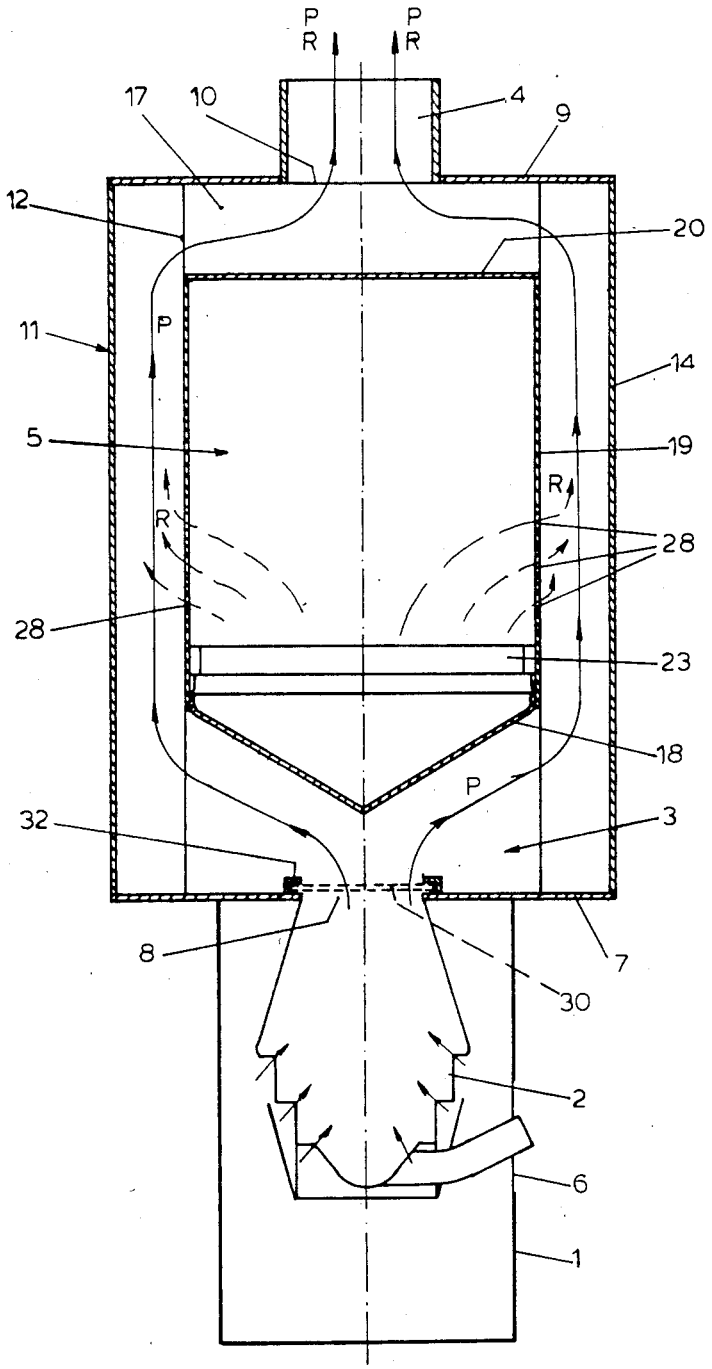
FIG. 2 schematically shows a cross-section taken along line II—II of FIG. 1.

As appears in particular from FIGS. 1 and 2, the side plates 19 of the combustion area 5 extend only over a limited height of the side walls 11 of the collecting area housing 3. As appears in particular from FIG. 2 the combustion gas, formed by the combustion of liquid fuel, can thus flow upward through the U-shaped channels 12 along the walls 19 of the combustion area 5, as indicated with the arrow P, and from there on between the wall 9 and upper plate 20 to the discharge conduit 4.

For the combustion of solid fuel in the combustion area 5 a grate 23 has been mounted within the combustion area with under it an ash pan 24, not shown in FIGS. 2 and 3.

An air-slide 25 has been mounted in the door 22 for adjustment of the supply of air to the lower side of the grate 23. In addition there is a strip 26 on the door 22, which connects with the front rim of the grate 23 when closing the door, so that no false air can be drawn in between the grate and the door. Finally there is a peeping-glass 27 in the door 22.

For the discharge of combustion gas from the burning area 5 openings 28 have been made in the side plates 19 of the combustion area, said openings emerging into the U-shaped channels 12 in such a manner that the flue gases formed in the combustion area 5 can evade to the discharge conduit 4 according to the arrows R as shown in FIG. 2.

As appears in particular from FIG. 3 a slot 29 is present in the front wall 16 of the collecting area 3, in which slot a cover plate 30 may be shoved for covering the slot 8 in the bottom plate 7 of the collecting area when solid fuel is combusted in the combustion area 5. It is obvious that the plate 30 will then extend over the full length of the collecting area, while the cover plate 30 is provided with a bent part 31 at its front edge and is guided by means of the guides 32, as these are shown in FIG. 2.

When liquid fuel is combusted, thus use being made of the burner area 1, the cover plate 30 will be removed and the slot 29 then can be sealed off by a platelet (not shown) with a short length, provided with a bent edge 31 in a similar manner, by which it is simultaneously prevented that the platelet will be pushed too far in the slot 29.

It will be obvious to those skilled in the art that various changes may be made without departing from the scope of the invention and the invention is not to be considered limited to what is shown in the drawings and described in the specification.

What is claimed is:

1. A stove for combusting both liquid and solid fuels, said stove comprising:

(A) a burner compartment (1), a burner for liquid fuel located within said burner compartment, (B) a combustion gas collecting chamber (3) overlying said burner compartment (1) for collecting combustion gas, said collecting chamber being composed of two spaced apart, vertical sidewalls, a front wall and a rear wall connecting said sidewalls, an upper wall (9) and a lower wall (7) extending between said side, front and rear walls, the lower wall being connected to said burner compartment to separate said burner compartment from the combustion gas collection chamber and having an opening for communicating the combustion gas out of said burner compartment into said combustion gas collecting chamber, (C) a discharge conduit (4) for the combustion gas, said discharge conduit (4) having a lower end connected to the upper wall of said combustion gas collecting chamber (3) and opening thereto;

(D) a solid fuel combustion chamber (5) positioned inside said collecting chamber (3) and consisting of:

(a) a horizontal separating plate (18) positioned horizontally at some distance above the burner compartment (1) and being fitted to the front-and rear-walls (16), (17) of the collecting chamber (3), and at least over a portion thereof spaced from the sidewalls of the collecting chamber (3), (b) two spaced apart vertical walls (19) each having a lower edge connected to a respective side edge of the separating plate (18) and extending substantially vertically upwards from said separating plate, terminating below said upper wall (9) and being spaced laterally from said sidewalls of said collecting chamber (3), said vertical walls being connected at opposite ends to said front and rear walls of said combustion gas collecting chamber.

(c) a substantially horizontally extending upper plate (20), positioned at some distance below the upper wall (9) of the collecting chamber (3) and above the separating plate (18) and being connected at opposite ends to said front- and rear-wall respectively, each of two side edges of said upper plate (20) being connected to a respective upper edge of one of said spaced apart vertical walls (19), (d) a door provided in the front wall (16) of the combustion chamber (5) for introducing solid fuel into said combustion chamber (5), and (e) openings provided in the lower part of said sidewalls (19) of said combustion chamber (5) for allowing combustion gas of solid fuel burned therein to escape to the discharge conduit (4) for the combustion gas, whereby the burner compartment for solid fuel is positioned within the collecting chamber for the combustion gases of the burner compartment for liquid and solid fuel while at the same time direct heat conduction occurs from the front and rear walls of the burner compartment for solid fuel to the atmosphere surrounding said stove.

2. A stove according to claim 1, wherein said sidewalls (19) of said collecting chamber (3) comprise vertically upright U-shaped channels including legs terminating in rims, said rims abutting said sidewalls (19) of said combustion chamber (5) and functioning to support said sidewalls (19) of said combustion chamber while allowing combustion gas from said burner compartment (1) to pass vertically through said collecting chamber sidewalls U-shaped channels.

3. A stove according to claim 1, wherein the U-shaped channels of each side wall of said collecting chamber comprise bent portions of one flat plate including outer parts and legs forming an obtuse angle with said outer parts, and said outer parts being positioned in one flat plane.

4. A stove according to claim 2, wherein the lower separating plate is V-shaped as viewed in cross-section and diverges upwardly to direct combustion air from burner compartment (1) through said substantially U-shaped channels of said collecting chamber sidewalls.

5. A stove according to claim 4, further comprising an adjustable air slide within said door at a level above the separating plate, and a removable cover plate means for preventing air from flowing to the combustion chamber from the burner compartment when said combustion chamber is in use for burning solid fuel.

6. A stove according to claim 5, wherein said removable cover plate means comprises a plate slidably mounted on said lower wall of said collecting chamber (3) so as to overlie the opening within said collecting chamber lower wall communicating said burner compartment (1) to said collecting chamber (3), and wherein a substantially horizontal slot is provided in one of the front- and rear-wall of said collecting chamber, and said removable cover plate is insertably positioned within said horizontal slot.

* * * * *